US011456089B2

(12) United States Patent
Olwage

(10) Patent No.: US 11,456,089 B2
(45) Date of Patent: Sep. 27, 2022

(54) DOWNLINE WIRE

(71) Applicant: Detnet South Africa (PTY) Ltd., Johannesburg (ZA)

(72) Inventor: Phillip Olwage, Sandton (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 321 days.

(21) Appl. No.: 16/618,330

(22) PCT Filed: May 23, 2018

(86) PCT No.: PCT/ZA2018/050025
§ 371 (c)(1),
(2) Date: Nov. 29, 2019

(87) PCT Pub. No.: WO2018/218262
PCT Pub. Date: Nov. 29, 2018

(65) Prior Publication Data

US 2021/0166835 A1 Jun. 3, 2021

(30) Foreign Application Priority Data

May 23, 2017 (ZA) ..... 2017/03516

(51) Int. Cl.
*H01B 7/04* (2006.01)
*F42D 1/045* (2006.01)
(Continued)

(52) U.S. Cl.
CPC ..... *H01B 7/04* (2013.01); *F42D 1/045* (2013.01); *F42D 3/00* (2013.01); *H01B 7/0869* (2013.01); *H01B 7/1825* (2013.01)

(58) Field of Classification Search
CPC ..... H01B 3/30; H01B 7/04; H01B 7/0869; H01B 7/1825; H01B 9/006; F42D 1/045; F42D 3/00; E21B 17/003; E21B 43/128
(Continued)

(56) References Cited

U.S. PATENT DOCUMENTS 6,506,492 B1 * 1/2003 Foulger ..... H01B 1/22 174/110 PM
2006/0019523 A1 * 1/2006 Laureano ..... H01R 13/523 439/310
(Continued)

FOREIGN PATENT DOCUMENTS

AU 2009101116 A4 * 11/2009 ..... F42D 1/00
AU 2009101116 A4 12/2009
(Continued)

OTHER PUBLICATIONS

International Preliminary Report on Patentability for PCT/ZA2018/050025, international filing date of May 23, 2018, dated Apr. 17, 2019, 12 pages.
(Continued)

*Primary Examiner* — William H. Mayo, III
(74) *Attorney, Agent, or Firm* — Cantor Colburn LLP

(57) ABSTRACT

A downline wire (10) serves to connect a location on the ground surface to at least one detonator (52) in a blast hole. The downline wire includes at least two flexible electrical conductors (12, 14) encased by respective flexible layers of an insulating material (20, 22) and a flexible sheath (24) in which the insulated conductors are embedded. Each conductor (12, 14) is made of a copper-clad steel core and the insulating material is either a filled flexible polyvinylchloride (PVC) composition or a polyester elastomer. The sheath (24) is made from a medium or high density polyethylene compound which includes carbon black.

27 Claims, 3 Drawing Sheets

(51) Int. Cl.
*F42D 3/00* (2006.01)
*H01B 7/08* (2006.01)
*H01B 7/18* (2006.01)

(58) Field of Classification Search
USPC ..... 174/102 R, 103, 108, 109, 110 R–110 N; 524/505
See application file for complete search history.

(56) References Cited

U.S. PATENT DOCUMENTS

| | | | | |
|---|---|---|---|---|
| 2010/0084158 | A1* | 4/2010 | Gau | C08L 23/04 174/110 SR |
| 2014/0158380 | A1* | 6/2014 | Varkey | E21B 44/005 166/386 |
| 2015/0131945 | A1* | 5/2015 | Scopic | B23P 11/005 385/87 |
| 2017/0110220 | A1* | 4/2017 | Romer | D07B 1/147 |

FOREIGN PATENT DOCUMENTS

| | | | |
|---|---|---|---|
| EP | 2232505 | B1 | 8/2015 |
| WO | 03044450 | A1 | 5/2003 |

OTHER PUBLICATIONS

International Search Report for PCT/ZA2018/050025, international filing date of May 23, 2018, dated Oct. 22, 2018, 6 pages.
Written Opinion for PCT/ZA2018/050025, international filing date of May 23, 2018, dated Oct. 22, 2018, 12 pages.

* cited by examiner

DOWNLINE WIRE

CROSS-REFERENCE TO RELATED APPLICATIONS

This application is a U.S. national stage application of International Application No. PCT/ZA2018/050025 entitled "DOWNLINE WIRE", which has an international filing date of 23 May 2018, and which claims priority to South African Patent Application No. 2017/03516, filed on May 23, 2017, and all the benefits accruing therefrom under 35 U.S.C. § 119, the content of which in its entirety is herein incorporated by reference.

BACKGROUND OF THE INVENTION

This invention relates to a downline wire which is used to establish contact between a surface location and a detonator which is located in a blast hole.

An electronic detonator can be deployed in different ways. In one instance a detonator and booster combination, connected to a downline wire, is placed into a blast hole before the blast hole is charged with an emulsion explosive. As the emulsion falls into the blast hole it impacts on the detonator and booster, thereby stressing the downline wire. The impact force produced thereby can have an adverse effect on the installation. The effect of the falling emulsion in a blast hole with a large diameter is greater than in a blast hole with a small diameter. In the latter case the wall of the blast hole slows the emulsion to some extent before it impacts the booster. In the former case there is less resistance exerted on the emulsion by the blast hole wall and the impact force is increased.

The rate of charge (kilogram per minute) also has an effect on the installation. In general terms the higher the charging rate the greater is the influence as there is more emulsion being placed into the blast hole per unit time.

In a different approach a booster/detonator combination is placed into a blast hole at the same time as the emulsion which is then allowed to "pull" the combination, plus the downline wire, into the blast hole.

Irrespective of the method which is used in deploying the detonator/booster combination the downline wire must be able to withstand the tensile forces which are exerted on the combination and on the downline wire by the emulsion.

After the explosive charge has been placed into the borehole a stemming procedure is carried out. Some time can pass before the detonator is ignited. During this period the explosive column which is constituted by the emulsion settles, an effect which is referred to as "slumping". For a number of reasons the slumping effect gradually increases the tensile force which is exerted on the downline wire.

It is thus of primary importance that the downline wire should be capable of resisting the forces which occur during placement of the emulsion explosive, and thereafter, for if the downline wire breaks it is not possible to fire the detonator.

The properties of the downline wire play a decisive role in the ability of the wire to absorb the forces which are exerted on the wire. In practice a compromise must be struck between the tensile strength of the downline wire and its elongation characteristic.

In this specification impact resistance is used to indicate the capability of a downline wire to resist breaking under shock loading, i.e., a situation in which the downline wire is stressed in a short time, e.g., when a booster/detonator combination is suspended from a downline wire in a blast hole which is then charged with an emulsion.

FIG. 1 of the accompanying drawings illustrates three curves A, B and C respectively of tensile force versus elongation for three downline wires of different constructions respectively referred to as wires 1, 2 and 3.

The curve A relates to the downline wire 1 which only breaks under the effect of a substantial force. Such breakage does not however require a significant amount of energy—a parameter which is given by the area under the curve A. Thus the downline wire cannot stretch to a significant extent before it breaks. The wire 1 is characterized as "strong, not tough".

The curve B relates to the downline wire 2 which is as strong as the downline wire 1 but the area beneath the curve B is larger than the area beneath the curve A. The downline wire 2 can absorb more energy before it fractures than the downline wire 1. The wire 2 is characterized as "strong, and tough".

The downline wire 3 which is associated with the curve C is relatively weak although it can elongate to about the same extent as the downline wire 2, before it breaks. The wire 3 is characterized to be "tough, not strong".

An object of the invention is to provide a downline wire that can exhibit desirable dynamic and static loading characteristics, i.e., a downline wire which can elongate to some extent in reaction to installation conditions but which has adequate tensile strength to withstand a substantial degree of elongation.

A further object is to provide a detonation system, and a method for loading a blast hole, which system and method are based on the use of the downline wire of the invention.

SUMMARY OF THE INVENTION

The invention provides in the first instance a downline wire for connecting a location on surface to at least one detonator in a blast hole, the downline wire including at least two flexible electrical conductors, a respective flexible layer of an insulating material which encases each conductor, and a flexible sheath in which the insulated conductors are embedded, wherein each conductor comprises a steel core which is clad with copper, the insulating material is selected from a filled flexible polyvinylchloride (PVC) composition and a polyester elastomer, and the sheath is made from a medium or high density polyethylene compound.

The PVC composition may have a density of from 1.3 to 1.4, preferably the density is 1.35; an "A" Shore hardness of from 93 to 103, preferably 98; an unaged tensile strength at breakage of from 17 to 23, preferably from 19 to 21 (kpsi); and an elongation of from 280 to 325, preferably from 295 to 310(%).

The polyester elastomer may have a tensile strength at breakage of from 43 to 53, preferably 48 kpsi; an elongation at breakage of from 330 to 370, preferably 350(%); and a nominal hardness of from 77 to 87 Shore D, preferably 82 Shore D.

The cross sectional size of each conductor may be dependent on intended applications of the downline wire. In one preferred embodiment the diameter of the steel core is from 0.5 to 0.7 mm and preferably is 0.6 mm. The steel may have a tensile strength of from 38 to 58 kg/mm$^2$ and preferably is 48 kg/mm$^2$; an elongation at breakage of from 18 to 30% and preferably is 24.5%; and a resistance of from 240 to 280 ohm/km and preferably is 260 ohm/km.

The polyethylene component should include carbon black. It has been found, surprisingly, that the inclusion of the carbon black in the polyethylene significantly enhances the strength of the sheath, and hence of the downline wire.

The sheath preferably has an outer profile that may be referred to as a "flattened oval" shape in that (in cross section) it has two opposed substantially parallel and flat sides, a first semi-circular edge between respective first ends of the flat sides, and a second semi-circular edge between respective second ends of the flat sides. This shape has been found to give a good compromise between strength and material usage, i.e., the control of material in the sheath.

Also provided by the invention is a detonation system to withstand forces from loading a blast hole, the detonation system comprising:

a detonator to provide a charge to ignite an explosive; and a downline wire to connect the detonator to a surface location, the downline wire comprising:

two conductors;

a flexible thermoplastic insulator encasing the two conductors; and a polyethylene sheath encasing the flexible thermoplastic insulator and the two conductors.

Preferably the downline wire is of the aforementioned kind.

The invention further extends to a method for loading a blast hole comprising: connecting a booster and a detonator to a downline wire, the downline wire comprising:

two conductors with a tensile strength from 38 kg/mm$^2$ to 58 kg/mm$^2$, and an elongation at breakage from 18% to 30%, a flexible thermoplastic insulator encasing the two conductors, and a sheath encasing the flexible layer and the two conductors, the sheath comprising a polyethylene compound;

placing the booster and the detonator in a blast hole; and filling the blast hole with an emulsion explosive where the detonator experiences a dynamic force that causes the downline wire to elongate while the blast hole is being filled, and a static force from the emulsion explosive in the blast hole.

BRIEF DESCRIPTION OF THE DRAWINGS

The invention is further described by way of example with reference to the accompanying drawings in which.

DESCRIPTION OF PREFERRED EMBODIMENT

Figure 1:
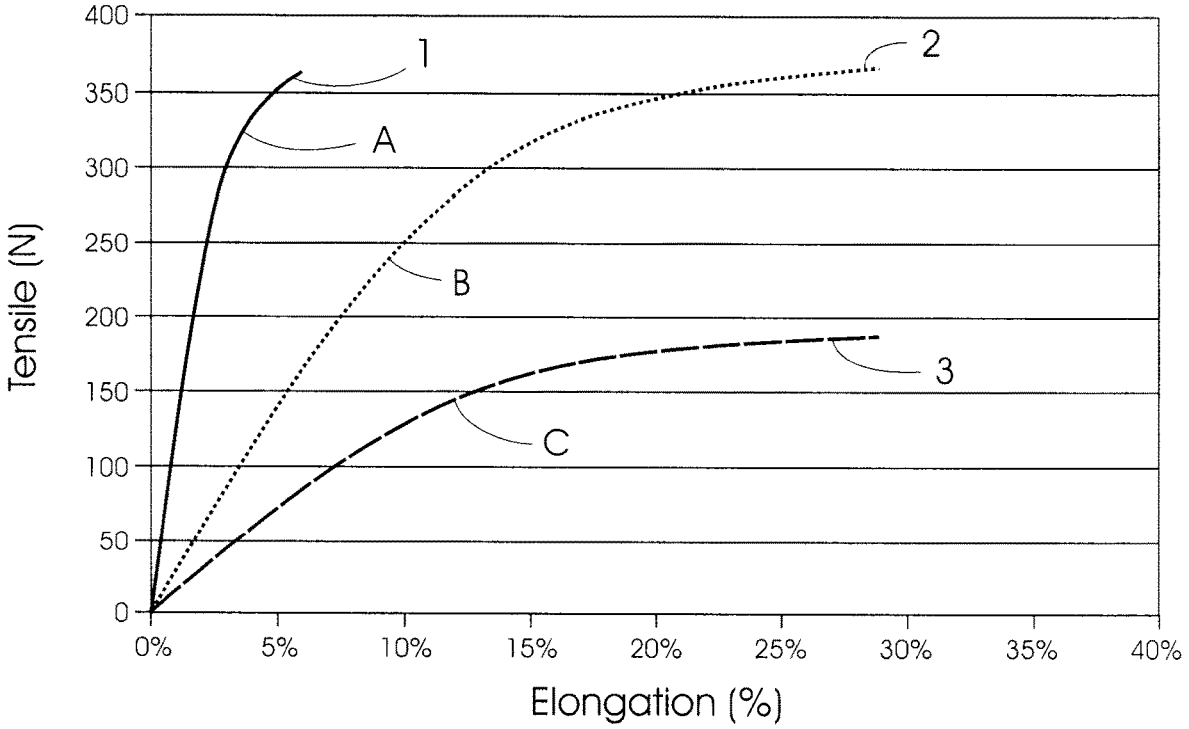
FIG. 1 illustrates tensile force versus elongation for three downline wires of different constructions.
Figure 2:
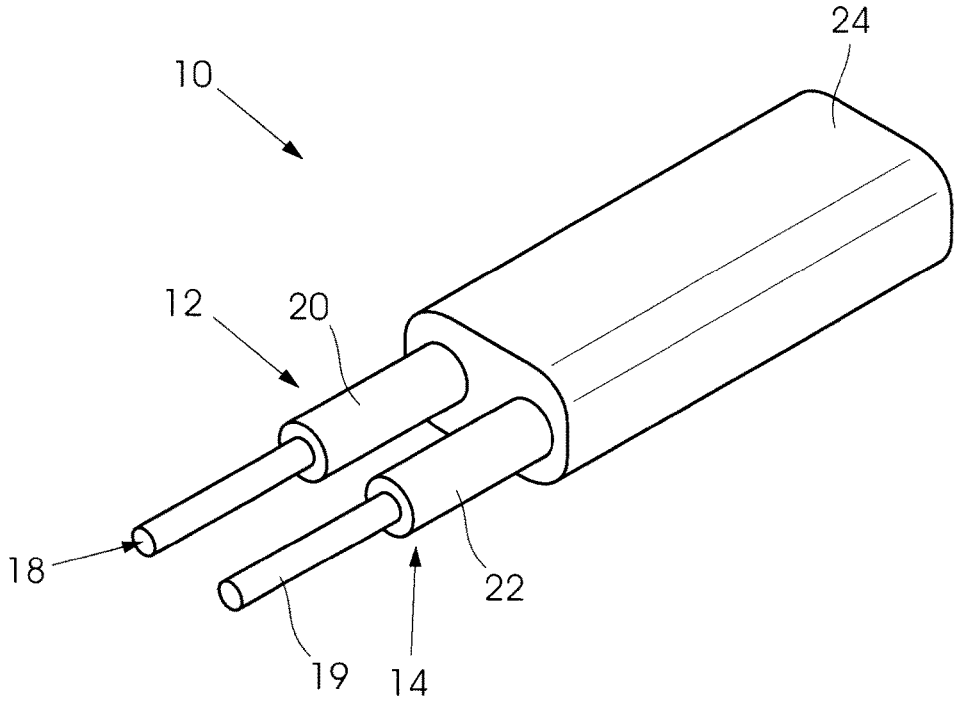
FIG. 2 illustrates in perspective a portion of a downline wire according to the invention.
Figure 3:
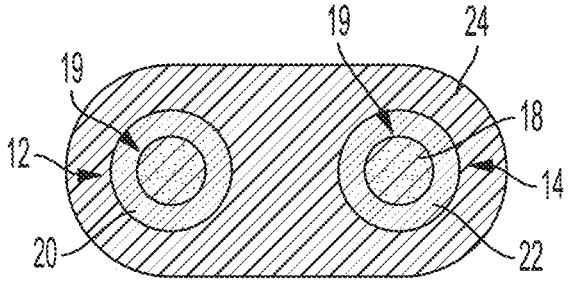
FIG. 3 shows the downline wire of FIG. 2 in cross section.

FIG. 2 of the accompanying drawings illustrates a portion of a downline wire 10 according to the invention. FIG. 3 shows the wire 10 in cross section.

The downline wire 10 includes two elongate flexible conductors 12 and 14, respectively, each of which comprises a respective steel core 18 with copper cladding 19 which is encased in an insulating material 20 and 22, respectively. Each core 18 has an appropriate diameter which is determined according to a particular application, such as from 0.5 mm to 0.7 mm. In a preferred embodiment each core has a diameter of the order of 0.6 mm and has the following specification: tensile strength=48.5 kg/mm$^2$; elongation=25%; resistance=265 ohms/km; conductivity=22.9%.

In use of the downline wire 10 the steel core offers substantial strength while the primary conductor of electricity is the copper cladding 19 on the outer surface of each core. The copper cladding 19 complies with 21% IACS (International Annealed Copper Standard). The insulation material (20 and 22) is a polyester elastomer or a filled, flexible PVC compound. In the former instance the polyester elastomer has the following characteristics: tensile strength at break=48.3 kpsi; elongation at break=350%; and hardness=82 D. In the latter case the PVC compound has a Shore (A) hardness of 98; an unaged tensile strength of 20.5 MPa; and an elongation of the order of 300%. The filler in the filled, flexible PVC may comprise calcium carbonate ($CaCO_3$).

The conductors 12 and 14 are positioned spaced apart and parallel to one another and are embedded in a sheath 24.

The sheath 24 is a medium to high density polyethylene compound which contains carbon black. This material composition exhibits substantial resistance to environmental stress cracking and to thermal oxidative degradation—properties which are attributable in part to the inclusion of the carbon black. Typical characteristics are as follows: density=0.95 g/cc; tensile strength=300 kg/cm$^2$; elongation=800%; hardness (Shore D)=59.

The applicant has found, surprisingly, that a downline wire made from the aforementioned materials exhibits significant benefits over other constructions known to the applicant. The inclusion of the carbon black, of up to 2.5% by weight, in the sheath 24 significantly improves the tensile sheath of the sheath and this helps to establish a desirable relationship of tensile strength to elongation of the downline wire. The insulating material on the bi-metal core has been found to interact with the sheath to provide highly satisfactory performance.

FIG. 3 illustrates a cross-sectional view of the downline wire 10, according to one embodiment. The profile of the downline wire 10 may limit forces on the downline wire when loading a blasthole, while maintaining abrasion resistance, tensile strength, and elongation properties.

In some embodiments, the distance between the center of each conductor 12,14 may be more than half of a cross-sectional length of the sheath 24 (such as, for example, 3.4 mm+/−0.15 mm). In some embodiments, a thickness of each of the insulating covers 20,22 may be equal to or less than one-third of a diameter of each of the two conductors. In some embodiments, a thickness of each of the insulating covers may be 35% to 25% of a diameter of each of the two conductors. In some embodiments, a width of the sheath 24 may be less than 0.6 times the cross-sectional length of the sheath 24, such as about 0.6 times to about 0.5 times the cross-sectional length of the sheath. In some embodiments, a width of the sheath may be equal to or less than the distance from center to center of the conductors (the distance between the centers of the conductors 12,14).

Figure 4:
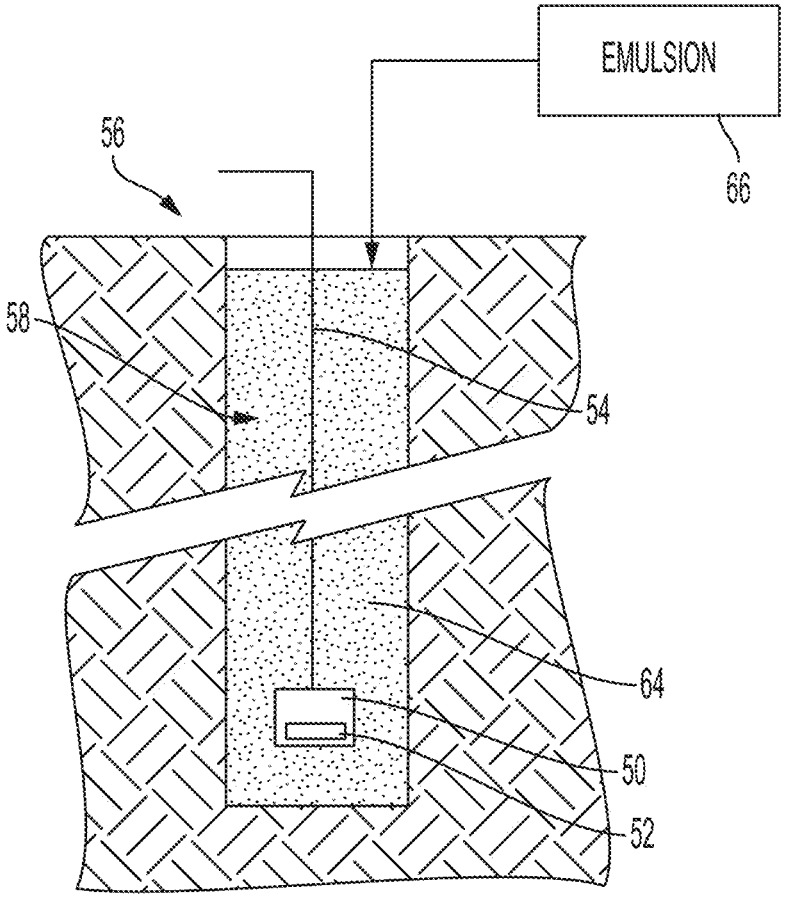
FIG. 4 shows a blast hole installation according to the invention.

FIG. 4 shows a blasthole installation implemented in accordance with the invention.

A booster 50 and a detonator 52, each of conventional configuration, are suspended from a downline wire 54 from a surface location 56 inside a blast hole 58. The downline wire 54 is of the kind described hereinbefore in that it includes two electrical conductors which are encased in a flexible thermoplastic insulator and a polyethylene sheath which encases the insulator and the conductors. Each conductor comprises a steel core and copper cladding. The steel core has a tensile strength of from 38 kg/mm$^2$ to 58 kg/mm$^2$ and an elongation at breakage of from 18% to 30%. The diameter of the steel core varies according to requirement but typically lies in a range of from 0.5 mm to 0.7 mm. The downline wire is secured at the surface location 56 using any appropriate technique.

Subsequently the blast hole 58 is filled with an emulsion explosion 64 from a loading device 66 at the surface location. During the filling process the detonator experiences a dynamic force that causes the downline wire 54 to elongate while the blast hole is being filled. The emulsion thereafter exerts a static force on the downline wire 54 inside the blast hole. The static force is directed onto the detonator/booster combination (50,52) and manifests itself also by means of a frictional engagement of the emulsion 64 with an outer surface of the downline wire 54.

Although the forces on the detonator/booster combination and on the downline wire depend on various factors it has been found that a downline wire 54 made in accordance with the aforementioned description can exhibit a tensile strength of up to 470 newtons (such as 400 newtons to 470 newtons or 250 newtons to 375 newtons) with an elongation of from 24 to 30%. This elongation allows the downline wire to stretch when the blast hole is being loaded and this, itself, enables the downline wire to handle the dynamic force. The tensile strength of the downline wire allows a static force of up to 470 newtons to be resisted.

Preferably the rate at which the emulsion is placed into the borehole is controlled, using previously derived empirical data, to ensure that the force produced by an explosive material impacting on the detonator/booster combination and on the downline wire does not exceed the rated characteristics of the downline wire. For example, delivery of an explosive material comprising an emulsion, a different mixture, e.g., ANFO, or both into the blast hole may be controlled so that a force on the booster, detonator, and the downline wire, is less than 350 N.

Figure 5:
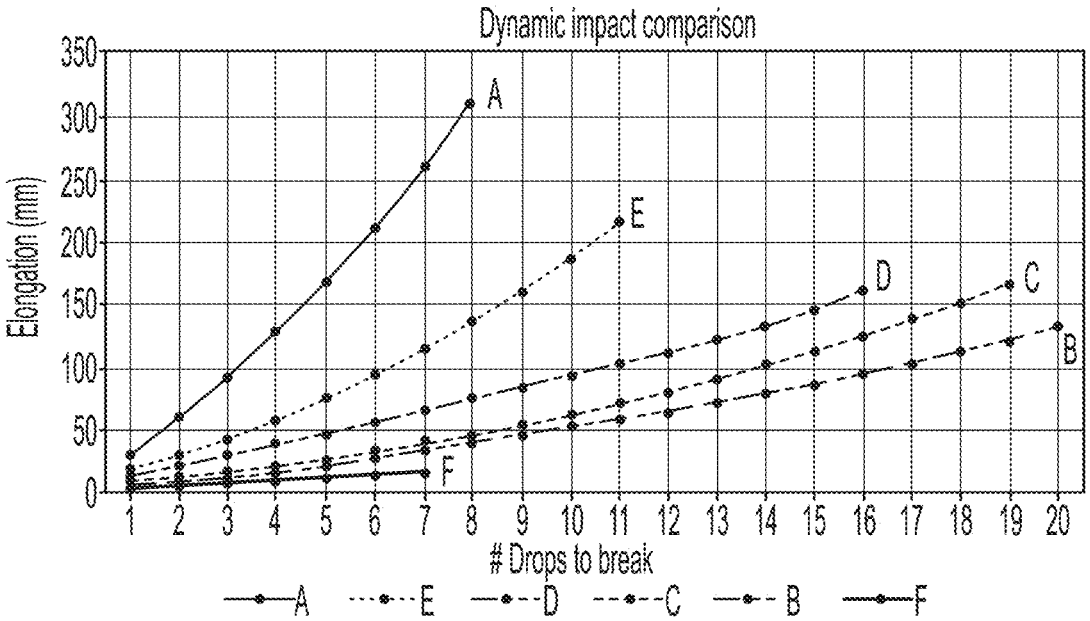
FIG. 5 shows the cross sectional shape of downline wires of various configurations, and comparative elongation curves as a function of a number of impacts, for the wires.
Figure 5:
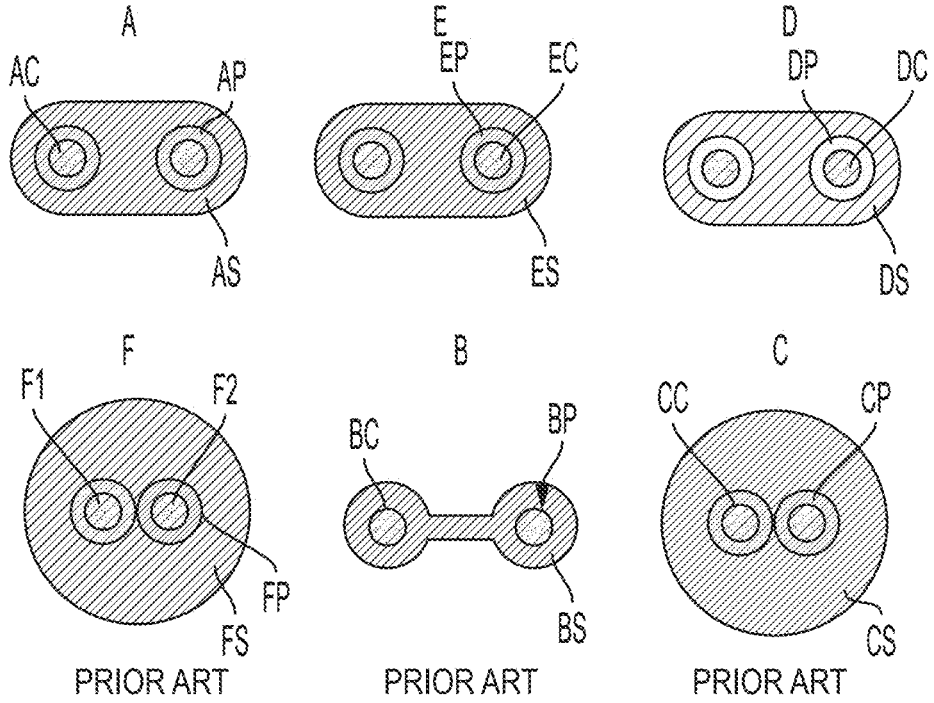

The capability of the downline wire, of the invention to function satisfactorily in the manners which have been described has been demonstrated through the use of practical installations, and extensive testing in which downline wires of the invention were compared to other (prior art) wires. The results of these comparative tests are shown in FIG. 5.

In each instance the downline wire was tested by attaching one end of the downline wire of a known length to a fixed support and a 5 kg weight to the other end of the wire. The 5 kg weight was then dropped, through a specified distance, to stress the downline wire. The dropping of the weight was repeated until the downline wire broke. The number of drops to break is reflected on the horizontal axis and the elongation in mm of the downline wire is given on the vertical axis.

The curves marked F, B and C respectively show the performance of commercially available downline wires (F, B and C) which are in current use.

The wire F has two copper cores F1,F2 which are insulated in polypropylene FP and which are encased in a TPU sheath FS of circular cross section.

The wire B has copper cores BC which are insulated with PVC BP and which are encased in a TPU sheath BS which has a double-doughnut configuration.

The wire C has two copper cores CC insulated with PVC CP embedded in an HDPE sheath CS which is circular in cross section.

The wires A, E and D are downline wires according to the invention. The downline wire A has copper clad steel cores AC which are insulated with PVC AP and which are embedded in a low-density polyethylene sheath AS which contains carbon black. The shape of the sheath is flattened oval.

The downline wire E has two copper clad steel cores EC which are insulated with a polyester elastomer EP of the kind referred to hereinbefore, and a medium density polyethylene sheath ES which includes carbon black and which has a flattened oval profile. The downline wire D is similar to the downline wire E except that the copper clad steel cores DC have PVC insulation DP.

The graphs in FIG. 5 reflect, in respect of each downline wire, elongation of the wire as a function of the number of drops of the 5 kg weight before the wire broke.

The downline wire A was capable of substantial elongation, but broke after 8 impacts. The downline wire E had a lesser degree of elongation but broke after 11 impacts. The downline wire D did not elongate as much as the downline wire E but withstood 16 impacts before breaking.

The prior art downline wire C could elongate to more or less the same extent as the wire D and could withstand 19 impacts. The downline wire B could elongate to a lesser extent than the wire C but withstood 20 impacts.

The downline wire F had minimal elongation and was capable of only withstanding 7 impacts of the 5 kg weight.

The tests indicate that the medium density polyethylene sheath, including carbon black, imparted desirable properties to the downline wires E and D.

The wire E which has bimetal cores and a high density polyethylene sheath which includes carbon black possesses significant tensile strength which is more or less equal to the tensile strength of the wires F and C despite the fact that the wires F and C include significantly more sheath material than the wire E. The wire E thus represents a good compromise between material usage, strength and impact resistance.

Further experiments with the medium density polyethylene sheath including 2.5 wt % carbon black are listed in Table 1. Averages for static tensile strength and static elongation are listed in Table 1. Static tensile strength in newtons ("N") and elongation percentage were determined with a tensile tester with static testing at 500 mm/min. Dynamic impact testing previously described herein was used to determine impact drops until fail.

TABLE 1

| | Wire 1 | Wire 2 | Wire 3 | Wire 4 |
|---|---|---|---|---|
| Conductor | 0.60 mm Bi-metal | 0.60 mm Bi-metal | 0.60 mm Bi-metal | 0.60 mm Bi-metal |
| Insulation | Polyester | PVC | Polyester | PVC |
| Jacket | MDPE | MDPE | MDPE | MDPE |
| | Test Result summary: | | | |
| Static tensile$_{avg.}$ | 465N | 416N | 457N | 348N |
| Static elongation$_{avg.}$ | 25% | 29% | 24% | 26% |
| Impact$_{drops\ until\ fail}$ | 20 | 16 | 17 | 15 |

The wires had a cross-sectional profile similar to FIG. 3 (i.e., flattened oval). Each of the 0.6 mm diameter conductors had a steel core with copper cladding. For wires 1-3: the cross-sectional length was 4.2 mm+/−0.15 mm; the width was 2.6 mm+/−0.15 mm; the distance from center to center of the two conductors was 2.1 mm+/−0.15 mm; and the distance from the insulating covers to the outer edge of the sheath (jacket) was 0.4 mm. For wire 4: the cross-sectional length was 3.4 mm+/−0.15 mm; the width was 1.8 mm+/−0.15 mm; the distance from center to center of the two conductors was 1.8 mm+/−0.15 mm; and the distance from the insulating covers to the outer edge of the sheath (jacket) was 0.3 mm.

In an aspect, disclosed is a downline wire for connecting a location on surface to at least one detonator in a blast hole, the downline wire including at least two flexible electrical conductors, a respective flexible layer of an insulating material which encases each conductor, and a flexible sheath in which the insulated conductors are embedded, wherein each conductor comprises a steel core which is clad with copper, the insulating material is selected from a filled flexible polyvinylchloride (PVC) composition and a polyester elastomer, and the sheath is made from a medium or high density polyethylene compound.

The PVC composition may have a density of from 1.3 to 1.4, an "A" Shore hardness of from 93 to 103, and an elongation of from 280 to 325.

The density may be 1.35, the "A" Shore hardness is 98, the unaged tensile strength at breakage is from 19 to 21 (kpsi) and the elongation is from 295 to 310(%).

The polyester elastomer may have a tensile strength at breakage of from 43 to 53, an elongation at breakage of from 330 to 370 and a nominal hardness of from 77 to 87 D.

The tensile strength of the wire at breakage may be 48 kpsi, the elongation at breakage is 350%, and the hardness is 82 D.

The diameter of the steel core may be from 0.5 to 0.7 mm and the steel has a tensile strength of from 38 to 58 kg/mm$^2$, an elongation at breakage of from 18 to 30% and a resistance of from 240 to 280 ohm/km.

The polyethylene component may comprise carbon black.

The sheath may have an outer profile comprising two opposed substantially parallel and flat sides, a first semi-circular edge between respective first ends of the flat sides, and a second semi-circular edge between respective second ends of the flat sides.

Also disclosed is a detonation system comprising:

a detonator to provide a charge to ignite an explosive; and a downline wire to connect the detonator to a surface location, the downline wire comprising:

two conductors;

a flexible thermoplastic insulator encasing the two conductors; and a polyethylene sheath encasing the flexible thermoplastic insulator and the two conductors.

Each of the two conductors may comprise a steel core and copper cladding.

The steel core may have a tensile strength from 38 kg/mm$^2$ to 58 kg/mm$^2$, and an elongation at breakage from 18% to 30%.

The steel core may have a diameter from 0.5 mm to 0.7 mm.

The flexible thermoplastic insulator may be a filled flexible polyvinylchloride composition.

The flexible thermoplastic insulator may have an unaged tensile strength at breakage from 17 kpsi to 23 kpsi, and an elongation at breakage from 280% to 310%.

The flexible thermoplastic insulator may be a polyester elastomer.

The flexible thermoplastic insulator may have an unaged tensile strength at breakage from 43 kpsi to 53 kpsi, and an elongation at breakage from 330% to 370%.

The system of claim 9, wherein the polyethylene sheath comprises a medium density polyethylene compound filled with carbon black (2.5 wt %).

The polyethylene sheath may have an unaged tensile strength at breakage of 300 kg/cm$^2$, and an elongation at breakage of 800%.

Also disclosed is a method for loading a blast hole comprising:

connecting a booster and a detonator to a downline wire, the downline wire comprising:

two conductors with a tensile strength from 38 kg/mm$^2$ to 58 kg/mm$^2$, and an elongation at breakage from 18% to 30%, a flexible thermoplastic insulator encasing the two conductors, and a sheath encasing the flexible layer and the two conductors, the sheath comprising a polyethylene compound;

placing the booster and the detonator in a blast hole; and filling the blast hole with an explosive material comprising an emulsion, a mixture, or both where the detonator experiences a dynamic force that causes the downline wire to elongate while the blast hole is being filled, and when a static force is exerted by the explosive material on the downline wire.

The downline wire may have a tensile strength from 400 N to 470 N or 250 N to 375 N, and an elongation of 24% to 30%.

The elongation of the downline wire may allow the downline wire to stretch between 24% to 30%.

The tensile strength of the downline wire may allow the downline wire to resist a static force of up to 470 N.

The method may further comprise determining a rate of charge to limit the dynamic force based on the diameter of the blast hole.

The flexible thermoplastic insulator may comprise one of a filled flexible polyvinylchloride composition or a polyester elastomer.

The mixture may comprise ANFO.

Also disclosed is method of manufacturing a downline wire for an explosive detonation system, the method comprising:

providing two copper-clad steel cores;

encasing each of the two copper-clad steel cores in a flexible thermoplastic insulator to form separate insulated conductors; and encasing both of the separate insulated conductors in a polyethylene sheath.

The flexible thermoplastic insulator may comprise a filled flexible polyvinylchloride composition.

The flexible thermoplastic insulator may comprise a polyester elastomer.

The polyethylene sheath may have a density of 0.95 g/cc.

Also disclosed is detonation system to withstand forces from loading a blast hole, the detonation system comprising:

a detonator to provide a charge to ignite an explosive; and a downline wire to connect the detonator to a surface location, the downline wire comprising:

two conductors;

two insulating covers encasing the two conductors; and a flattened-oval sheath encasing the insulating covers and the two conductors, wherein the distance between a center of each conductor is more than half of a cross-sectional length of the sheath.

A thickness of each of the insulating covers may be equal to or less than one-third of a diameter of each of the two conductors.

A thickness of each of the insulating covers may be between 35% to 25% of the diameter of each of the two conductors.

A width of the sheath may be less than 0.6 times the cross-sectional length of the sheath.

A width of the sheath may be equal to or less than the distance between a center of each conductor.

Each of the two conductors may comprise a steel core and copper cladding.

The steel core may have a tensile strength from 38 $kg/mm^2$ to 58 $kg/mm^2$, and an elongation at breakage from 18% to 30%.

The steel core may have a diameter from 0.5 mm to 0.7 mm.

The flexible thermoplastic insulator may be a filled flexible polyvinylchloride composition.

The filled flexible polyvinylchloride composition may be filled with $CaCO_3$.

The flexible thermoplastic insulator may have an unaged tensile strength at breakage from 17 kpsi to 23 kpsi, and an elongation at breakage from 280% to 310%.

The flexible thermoplastic insulator may be a polyester elastomer.

The flexible thermoplastic insulator may have an unaged tensile strength at breakage from 43 kpsi to 53 kpsi, and an elongation at breakage from 330% to 370%.

The polyethylene sheath may comprise a medium density polyethylene compound filled with carbon black.

The polyethylene sheath may have an unaged tensile strength at breakage of 300 $kg/cm^2$, and an elongation at breakage of 800%

Also disclosed is a method of loading a blasthole, the method comprising:

connecting a booster and a detonator to a downline wire;

placing the booster, the detonator, and the downline wire in a blasthole; and controlling delivery of an explosive material comprising an emulsion, mixture, or both into the blast hole so that a force on the booster, detonator, and the downline wire is less than 350 N.

The mixture may comprise ANFO.

What is claimed is:

1. A downline wire for connecting a location on surface to at least one detonator in a blast hole, the downline wire including at least two flexible electrical conductors, a respective flexible layer of an insulating material which encases each conductor, and a flexible sheath in which the insulated conductors are embedded, wherein each conductor comprises a steel core which is clad with copper, the insulating material is selected from a filled flexible polyvinylchloride (PVC) composition and a polyester elastomer, and the sheath is made from a medium or high density polyethylene compound which includes carbon black.

2. A downline wire according to claim 1 wherein the PVC composition has a density of from 1.3 $g/cm^3$ to 1.4 $g/cm^3$, an "A" Shore hardness of from 93 A to 103 A, and an elongation of from 280% to 325%.

3. A downline wire according to claim 2 wherein the density is 1.35 $g/cm^3$, the "A" Shore hardness is 98 A, the unaged tensile strength at breakage is from 131 $N/mm^2$ to 145 $N/mm^2$ and the elongation is from 295% to 310%.

4. A downline wire according to claim 1 wherein the polyester elastomer has a tensile strength at breakage of from 296 $N/mm^2$ to 365 $N/mm^2$, an elongation at breakage of from 330% to 370% and a nominal "D" Shore hardness of from 77 D to 87 D.

5. A downline wire according to claim 1 wherein the tensile strength of the wire at breakage is 331 $N/mm^2$, the elongation at breakage is 350%, and the hardness is 82 D.

6. A downline wire according to claim 1 wherein the diameter of the steel core is from 0.5 mm to 0.7 mm and the steel has a tensile strength of from 373 $N/mm^2$ to 569 $N/mm^2$, an elongation at breakage of from 18% to 30% and a resistance of from 240 to 280 ohm/km.

7. A downline wire according to claim 1 wherein the sheath has an outer profile comprising two opposed substantially parallel and flat sides, a first semi-circular edge between respective first ends of the flat sides, and a second semi-circular edge between respective second ends of the flat sides.

8. A detonation system comprising:

a detonator to provide a charge to ignite an explosive; and a downline wire to connect the detonator to a surface location, the downline wire comprising:

two conductors;

a flexible thermoplastic insulator encasing the two conductors; and a polyethylene sheath encasing the flexible thermoplastic insulator and the two conductors wherein the polyethylene sheath comprises a medium density polyethylene compound filled with carbon black (2.5%).

9. The system of claim 8 wherein each of the two conductors comprise a steel core and copper cladding.

10. The system of claim 9, wherein the steel core has a tensile strength from 373 $N/mm^2$ to 569 $N/mm^2$, and an elongation at breakage from 18% to 30%.

11. The system of claim 9, wherein the steel core has a diameter from 0.5 mm to 0.7 mm.

12. The system of claim 8, wherein the flexible thermoplastic insulator is a filled flexible polyvinylchloride composition.

13. The system of claim 12, wherein the flexible thermoplastic insulator has an unaged tensile strength at breakage from 117 $N/mm^2$ to 159 $N/mm^2$, and an elongation at breakage from 280% to 310%.

14. The system of claim 8, wherein the flexible thermoplastic insulator is a polyester elastomer.

15. The system of claim 14, wherein the flexible thermoplastic insulator has an unaged tensile strength at breakage from 296 $N/mm^2$ to 365 $N/mm^2$, and an elongation at breakage from 330% to 370%.

16. The system of claim 8, wherein the polyethylene sheath has an unaged tensile strength at breakage of 29.4 $N/mm^2$, and an elongation at breakage of 800%.

17. A method for loading a blast hole comprising:

connecting a booster and a detonator to a downline wire, the downline wire comprising:

two conductors with a tensile strength from 373 $N/mm^2$ to 569 $N/mm^2$, and an elongation at breakage from 18% to 30%, a flexible thermoplastic insulator encasing the two conductors, and a sheath encasing the flexible layer and the two conductors, the sheath comprising a polyethylene compound wherein the polyethylene sheath comprises a polyethylene compound filled with carbon black;

placing the booster and the detonator in a blast hole; and filling the blast hole with an explosive material comprising an emulsion, a mixture, or both where the detonator experiences a dynamic force that causes the downline wire to elongate while the blast hole is being filled, and when a static force is exerted by the explosive material on the downline wire.

18. The method of claim 17, wherein the downline wire has a tensile strength from 400N to 470N, and an elongation of 24% to 30%.

19. The method of claim 18, wherein the elongation of the downline wire allows the downline wire to stretch between 24% to 30%.

20. The method of claim 18, wherein the tensile strength of the downline wire allows the downline wire to resist a static force of up to 470N.

21. The method of claim 17, further comprising determining a rate of charge to limit the dynamic force based on the diameter of the blast hole.

22. The method of claim 17, wherein the flexible thermoplastic insulator comprises one of a filled flexible polyvinylchloride composition or a polyester elastomer.

23. The method of claim 17, wherein the explosive mixture comprises ANFO.

24. A method of manufacturing a downline wire for an explosive detonation system, the method comprising:

providing two copper-clad steel cores;

encasing each of the two copper-clad steel cores in a flexible thermoplastic insulator to form separate insulated conductors; and encasing both of the separate insulated conductors in a polyethylene sheath wherein the polyethylene sheath comprises a polyethylene compound filled with carbon black.

25. The method of claim 24, wherein the flexible thermoplastic insulator comprises a filled flexible polyvinylchloride composition.

26. The method of claim 24, wherein the flexible thermoplastic insulator comprises a polyester elastomer.

27. The method of claim 24, wherein the polyethylene sheath has a density of 0.95 g/cc.

* * * * *